United States Patent [19]

Wittwer

[11] 4,375,790

[45] Mar. 8, 1983

[54] OFFSET PRINTER

[76] Inventor: Fritz Wittwer, 29, Fort St. Jacques, CH-1700 Fribourg, Switzerland

[21] Appl. No.: 263,314

[22] Filed: May 13, 1981

[30] Foreign Application Priority Data

Jun. 2, 1980 [EP] European Pat. Off. ..... 80810187.7

[51] Int. Cl.[3] ..... B05C 1/02

[52] U.S. Cl. ..... 118/219; 118/262

[58] Field of Search ..... 118/218, 219, 232, 233, 118/259, 261, 262, 211

[56] References Cited

U.S. PATENT DOCUMENTS

| | | | |
|---|---|---|---|
| 2,158,495 | 5/1939 | Crighton et al. | 118/259 |
| 3,225,688 | 12/1965 | Gillies et al. | 101/36 |
| 3,603,250 | 9/1971 | Knudsen | 101/36 |
| 4,077,355 | 3/1978 | Miller | 118/219 |
| 4,095,556 | 6/1978 | Dawson et al. | 118/219 X |

FOREIGN PATENT DOCUMENTS

| | | |
|---|---|---|
| 841247 | 6/1952 | Fed. Rep. of Germany . |
| 1566908 | 5/1969 | France . |
| 1163673 | 9/1969 | United Kingdom . |

*Primary Examiner*—John P. McIntosh
*Attorney, Agent, or Firm*—Ladas & Parry

[57] ABSTRACT

The offset printer is intended for printing annular codes of colors on small solids of revolution like contact pins or necks of ampoules. A plurality of axially shifted devices for distributing the color, each one comprising a color disc are assigned to the inking cylinder. The color discs enter into a color chamber and come out from this chamber free from play between axial limitations which act as strippers. The color discs are joined with their drive in a slightly loose manner so that they can fully adapt themselves to the position of the axial limitations. This permits to print fully clean, small rings of colors on small solids of revolution.

3 Claims, 5 Drawing Figures

OFFSET PRINTER

BACKGROUND OF THE INVENTION

The present invention relates to an offset printer for printing annular codes of colours on solids of revolution and more particularly on small solids of revolution like connector contacts or necks of ampoules in which the colour is applied to a common inking cylinder by means of rotative discs.

There exists a more and more increasing need for identifying small solids of revolution, e.g. connector contacts or contact pins of small dimensions for electronic components and the like by marking them with annular codes of colours. With a view to the small dimensions of such parts having e.g. an available printable surface of 1 mm in diameter and 3 to 4 mm in length it is required to provide clean, sharp limited printings of relativ narrow colour rings. Tests have shown that the offset printing of small parts with clean rings of colour leads to particular difficulties because it is particularly not easy to deposit the colour on the inking cylinder in a sufficiently clean manner.

It is accordingly the object of the present invention to realize an offset printer which permits to deposit clean, sharp delimited annular codes of colours on very small solids of revolution. It has been determined that the above mentionned difficulties are due to the fact that during the transfer of the colour from the colour chambers to the inking cylinder, the colour is not cleanly enough stripped off from the relative discs. It has been further discovered that the reason for this defect is that with a rigid arrangement of the discs and the colour chambers it is impossible to realize a close enough fitting of the discs with respect to the axial limitations of the slit through which the discs enter the colour chambers.

SUMMARY OF THE INVENTION

According to the present invention, the above mentioned defect can be avoided by loosely joining each disc with its drive, the disc lying in a plane which is determined by close fitting of the disc against axial limitations between which said disc enters free from play into a corresponding colour chamber. This permits for each disc to be guided without to stick yet practically without play between lateral limitations which cleanly strip off laterally the colour which is taken along by the disc, thus realizing the assumption for a corresponding clean printing of the colour rings on the solids of revolution.

The invention will be described further, by way of example with reference to the accompanying drawings.

DESCRIPTION OF THE PREFERRED EMBODIMENT

Figure 1:
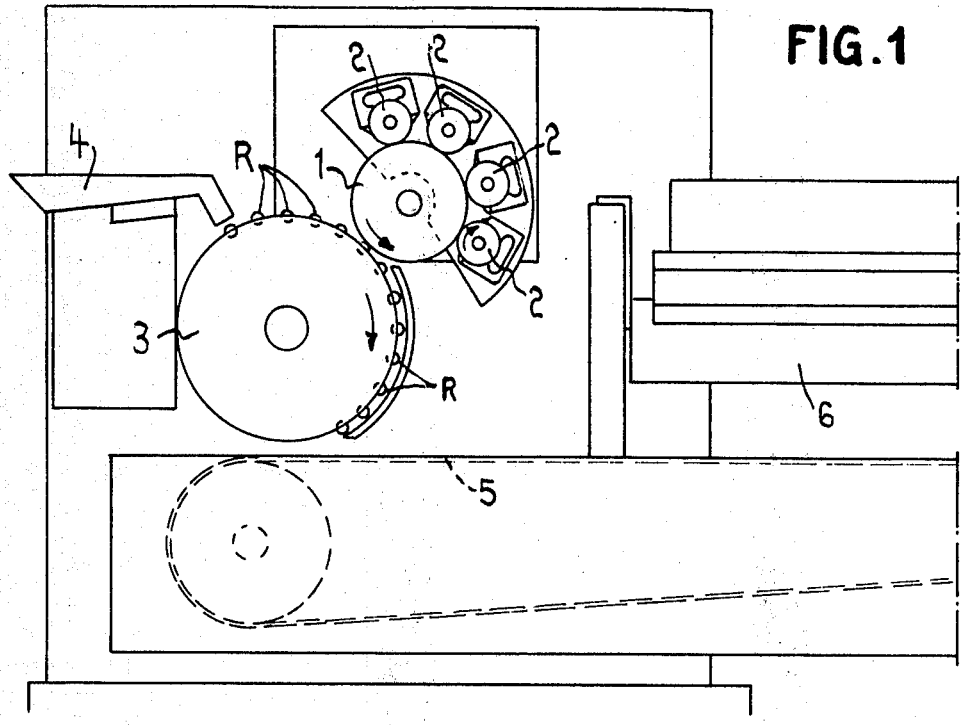
FIG. 1 shows more or less diagrammatically an installation for printing solids of revolution.

The installation shown in FIG. 1 comprises a diagrammatically represented printer with an inking cylinder 1. The colour is transferred to the inking cylinder 1, as explained later, by means of diagrammatically represented discs 2 which are arranged in axially shifted positions. A conveyor wheel 3 is disposed at the side, under the inking cylinder for receiving and rotatively holding the solids of revolution R. The solids of revolution are fed from a feeding and orienting device not represented through a channel 4 and deposited individually on the conveyor wheel 3 which advances step by step in a clockwise direction. Each one of the solids of revolution then reaches a printing position in the range of the inking cylinder 1. The printed solids of revolution finally leave the conveyor wheel 3 through a corresponding outlet at the base thereof and reach a belt conveyor 5 which carry them to an oven 6 for drying or burning the colour.

Figure 2:
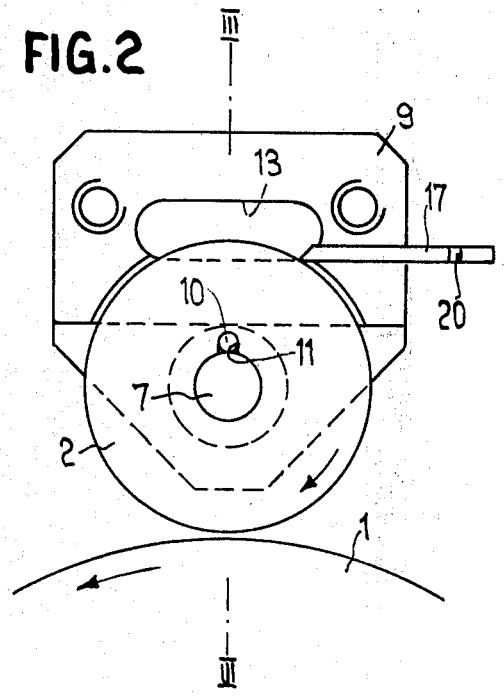
FIG. 2 is a side view of a device for distributing the colour in which part of the colour chamber is removed.
Figure 3:
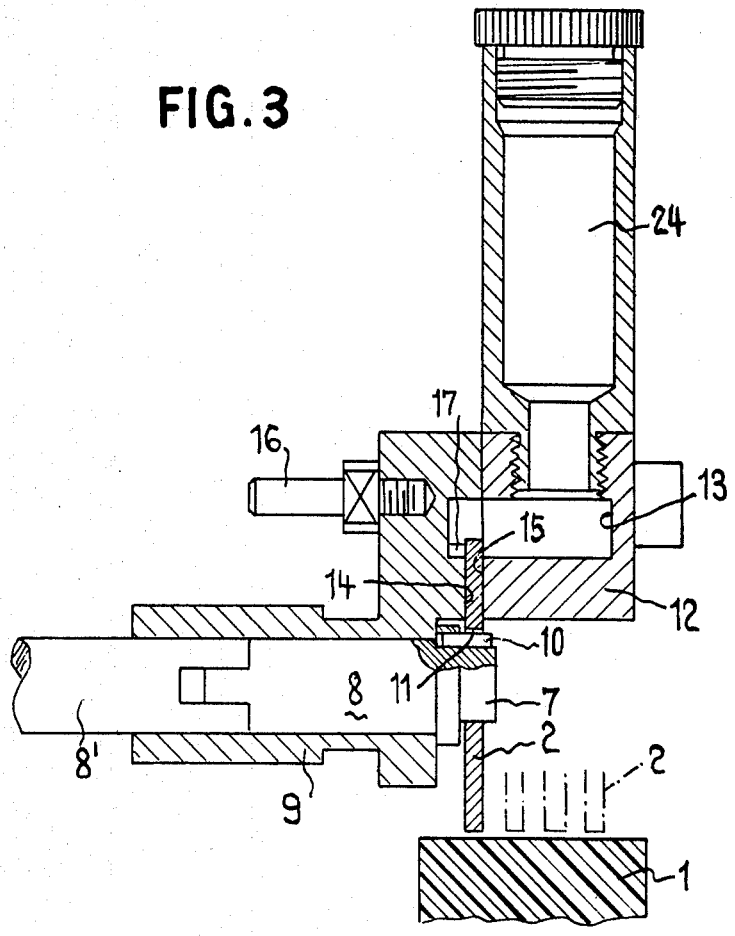
FIG. 3 is a section through line III—III of FIG. 2.
Figure 4:
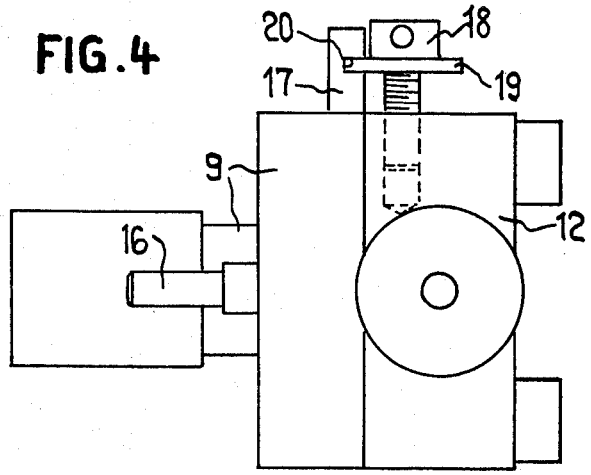
FIG. 4 is a top view of the device for the application of the colours.

FIGS. 2 to 4 show a device for distributing the colour with a rotative disc 2. The disc 2 is supported with a play of e.g. 1 to 3 hundreths of a millimeter on the reduced end part 7 of a driving shaft 8 which is mounted in a bearing of a housing part 9. The shaft 8 is detachably coupled with a further part 8' of the driving shaft. Within a bore of the driving shaft 8 is embedded a driving pin 10 which engages in a recess of the disc 2. The disc is therefore loosely supported by the driving shaft 8 in such manner that it does not stand by all means perpendicular to the axis of the shaft 8. However, the disc is driven by the rotative driving shaft 8 and the driving pin 10, as explained above.

The disc 2 enters through a slit between the housing part 9 and a housing part 12 in a colour chamber 13 which continuously receives colour from a colour tank 24. The housing parts 9 and 12 form axial limitations 14, respectively 15 between which the disc 2 enters in the colour chamber 13 practically without any play. Orientation pins 16 are screwed in the housing part 9 for permitting the assembly of the device for distributing the colour to the machine frame, as indicated in FIG. 1. From one side, a stripper 17 in form of a knife, sticks out in the colour chamber 13. According to FIG. 4, the stripper may be fine adjusted by means of a screw 18 the flange 19 of which entering in a gap 20 of the stripper 17.

As indicated by arrows in FIG. 2, the inking cylinder rotates in a counterclockwise direction while the discs 2 are driven in the clockwise direction. The edge of the disc which is in the colour chamber 13 then takes up the colour which at the outlet of the colour chamber is cleanly stripped off by the stripper 17 at the peripheral surface of the disc 2 and at its front faces by the close fitting limitations 14 and 15, respectively by the internal end cants thereof. As already mentioned, the disc 2 may take if necessary a position slightly inclined with respect to the axis of the driving shaft 8. This permits to the disc to engage between the limitations 14 and 15 without to stick and practically without any play. As indicated, the experience has shown that these conditions must be fulfilled to insure a clean enough transfer of the colour from the disc 2 to the inking cylinder 1 and finally from the latter to the solid of revolution to be printed. It is of importance that the stripping off occurs with accuracy at the same place or, with other words, that the sharp edge of the stripper 17 adjacent to the disc 2 lies in the same plane as the lower limitating faces of the colour chamber 13.

Figure 5:
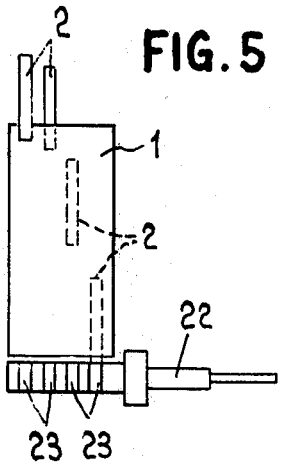
FIG. 5 shows diagrammatically the inking cylinder in contact with a solid of revolution to be printed.

FIG. 5 shows diagrammatically the discs 2 which are arranged along the periphery of the inking cylinder 1, each disc providing a colour ring on the inking cylinder 1. A solid of revolution, e.g. a contact pin 22 is in contact with the inking cylinder 1 for being printed with the desired annular code of colours.

The required loose suspension of the discs 2 could also be realized by other means. It would be possible for example to arrange each one of the discs in a fixed manner on a driving shaft tiltable in its bearings. Other signs, e.g. signets, could also be printed in addition to the annular code of colours. The thread in the opening of the colour tank 24 can also be designed for the acceptance of colour tubes directly screwed in the opening of the colour tank.

I claim:

1. Offset printer apparatus for printing annular codes of colors on solids of revolution, more particularly on small solids of revolution such as connector contacts or necks of ampoules, transported on a conveyor, comprising a common inking cylinder for printing a plurality of rings of colors onto said solids of revolution at a printing position of said conveyor adjacent said inking cylinder, a plurality of rotatable discs located around at least part of the surface of said inking cylinder, said discs contacting at their peripheries the surface of said inking cylinder for depositing said rings of colors onto said inking cylinder, driving means for rotating said discs including a driving shaft having a fixed axis, the plane of each said discs being slightly tiltable about a plane perpendicular to said axis, said plane of each disc being determined by close fitting of the disc against axial limitations between which said disc enters free from play into a corresponding color containing chamber of said printer apparatus.

2. Printer apparatus according to claim 1 wherein each disc is mounted on a corresponding fixed driving shaft with a predetermined play for rendering said disc tiltable about said perpendicular plane, said disc being driven by a pin attached to said driving shaft.

3. Printer apparatus according to claim 1 or 2, wherein a stripper is provided within the axial limitations against the peripheral surface of each disc, said stripper having a sharp edge adapted to contact the periphery of said disc and lying in the same plane as the limiting wall of the color containing chamber through which said disc enters into said chamber.

* * * * *